US005456337A

United States Patent [19]

Jackson

[11] Patent Number: 5,456,337

[45] Date of Patent: Oct. 10, 1995

[54] ANTI-ROTATION MEMBER FOR RAILCAR BRAKE BEAM

[76] Inventor: Robert G. Jackson, 1556 Jasmine Rd., St. Joseph, Mich. 49085

[21] Appl. No.: 373,872

[22] Filed: Jan. 17, 1995

Related U.S. Application Data

[63] Continuation of Ser. No. 114,833, Sep. 2, 1993, abandoned.

[51] Int. Cl.[6] ..... B66D 13/00; F16D 65/14

[52] U.S. Cl. ..... 188/52; 188/212; 188/222.6; 188/233.3

[58] Field of Search ..... 188/53, 54, 55, 188/197, 212, 207, 219.1, 219.6, 222.1, 222.6, 223.1, 231, 233.3

[56] References Cited

U.S. PATENT DOCUMENTS

| | | | |
|---|---|---|---|
| 2,170,123 | 8/1939 | Busch | 188/212 |
| 2,918,149 | 12/1959 | McClure et al. | 188/197 |
| 3,169,609 | 2/1965 | Opsahl | 188/222.6 |
| 4,480,721 | 11/1984 | Murphy | 188/233.3 |
| 4,519,480 | 5/1985 | Nelson | 188/222.6 |

*Primary Examiner*—John J. Oberleitner
*Assistant Examiner*—Kevin D. Rutherford
*Attorney, Agent, or Firm*—Baker & Daniels

[57] ABSTRACT

An anti-rotation extension for a railcar braking system. The extension is connected to a brake beam and rides in a frame located guide channel. The channel is preferably oriented offset from the center axis of rotation of the roller wheels. The extension preferably includes flattened portions to prevent rotation of the beam as the brakes are applied.

3 Claims, 4 Drawing Sheets

ANTI-ROTATION MEMBER FOR RAILCAR BRAKE BEAM

This is a continuation of application Ser. No. 08/114,833 filed on Sep. 2, 1993, now abandoned.

SUMMARY OF THE INVENTION

This invention relates to railcar brake beams.

Railroad car braking systems typically use opposed brake beams which carry brake shoes positioned adjacent to the car wheels. As the beams are shifted into a braked position, the shoes frictionally engage the wheels to slow and stop the railcar.

Existing railcar beams align the curved brake shoes such that the entire shoe contacts the wheel at the same time. In actual application, this causes uneven shoe wear due to rotation of the brake beam along the direction of wheel travel.

The brake beam of this invention includes an end located alignment member which cooperates with the railcar frame to align the brake shoes with the wheels during braking operations, and to prevent the beam rotation which causes uneven shoe wear. In the unbraked position, the end extension or alignment member holds the beam in a preferred orientation adjacent to the wheels.

It is therefore a principal object of this invention to provide for a novel and improved brake beam for railcars.

Another object is to provide for a railcar brake beam which allows for even brake shoe wear.

Another object is to provide for a railcar brake beam extension which prevents beam rotation during braking operations.

Other objects will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable others skilled in the art to follow its teachings.

Figure 1:
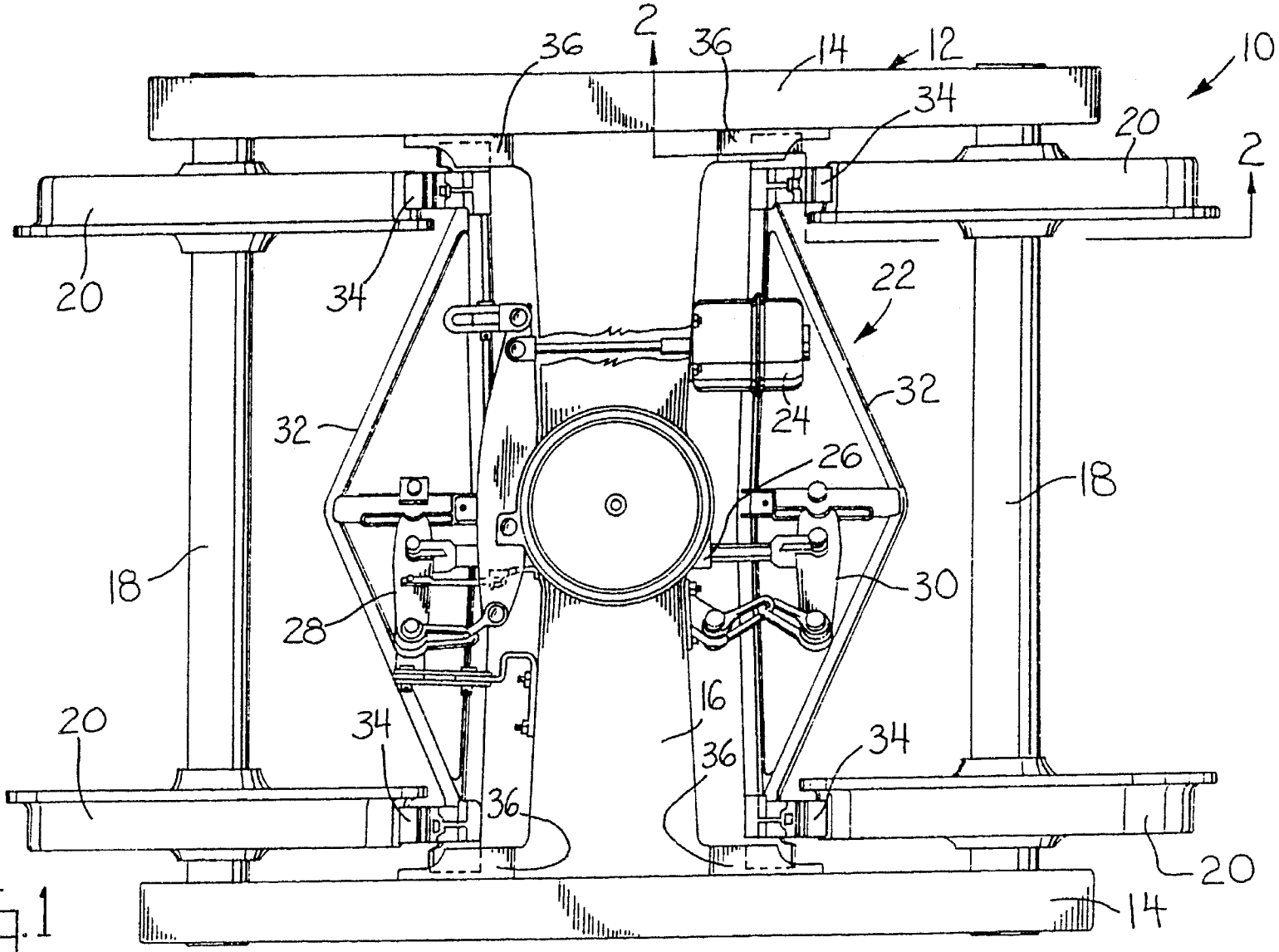
FIG. 1 is a top plan view of a railcar braking system which utilizes the brake beam of this invention.

Referring first to FIG. 1, reference numeral 10 generally designates a railcar. Railcar 10 includes frame chassis 12 which generally includes spaced frame rails 14 connected by bolster 16. Axles 18 accommodate rotatable wheels 20 and are journalled in frame rails 14 in a common manner.

Brake system 22 is connected to railcar 10 and serves to slow and/or stop the car in a common manner. Brake system 22 may be employed in the truck mounted fashion shown or may be employed in a common railcar design known to the industry. System 22 as shown includes generally a power driven cylinder 24, slack adjuster 26, connecting linkages and levers 28, 30, and brake beams 32 which carry brake shoes 34. Brake shoes 34 are positioned adjacent to wheels 20 as shown in the drawings and serve to slow and/or stop the railcar 10 by friction.

Figure 2:
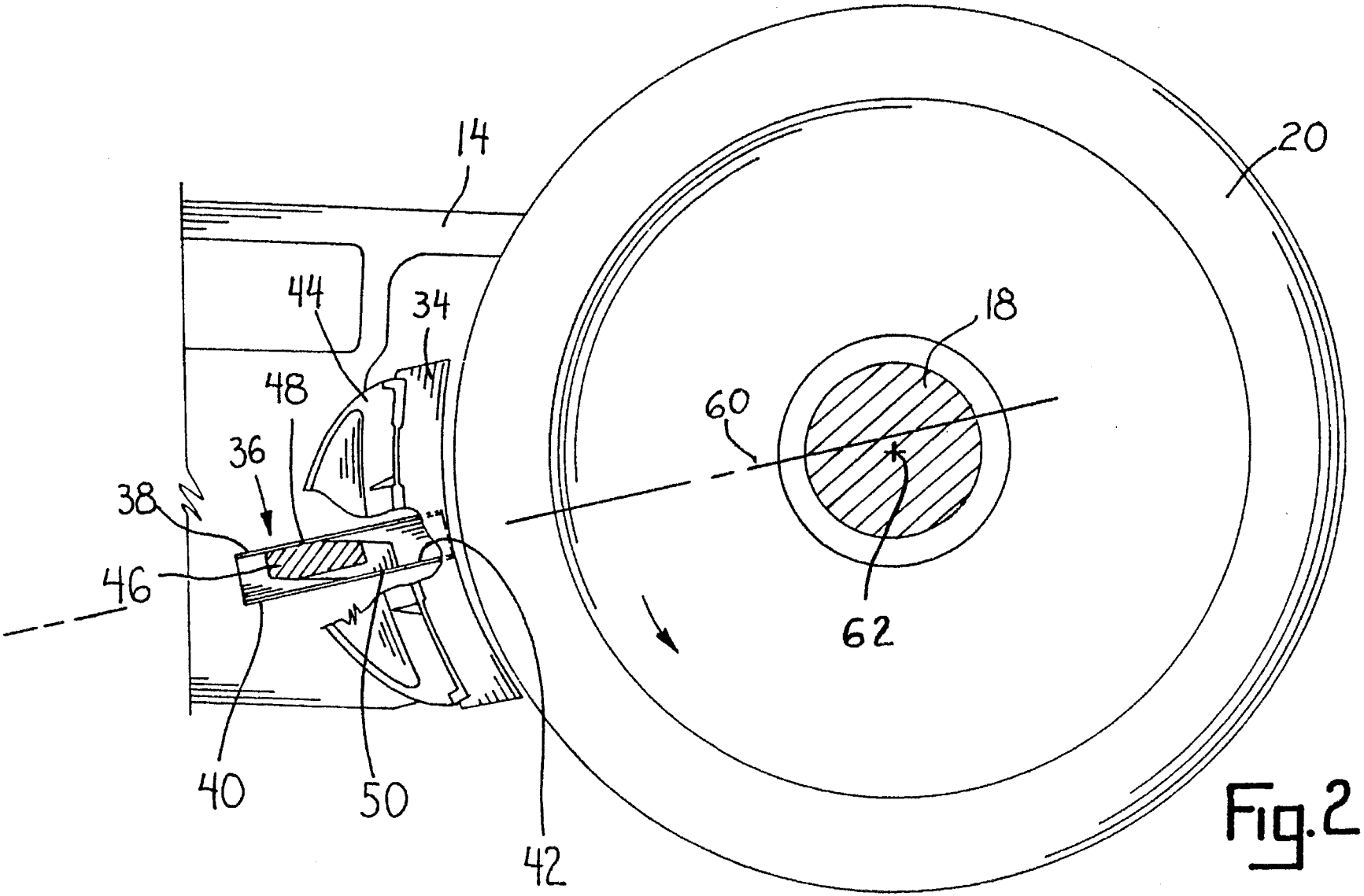
FIG. 2 is a sectional view taken along line 2—2 of FIG. 1, showing the brake beam in a relaxed, or unbraked position.
Figure 3:
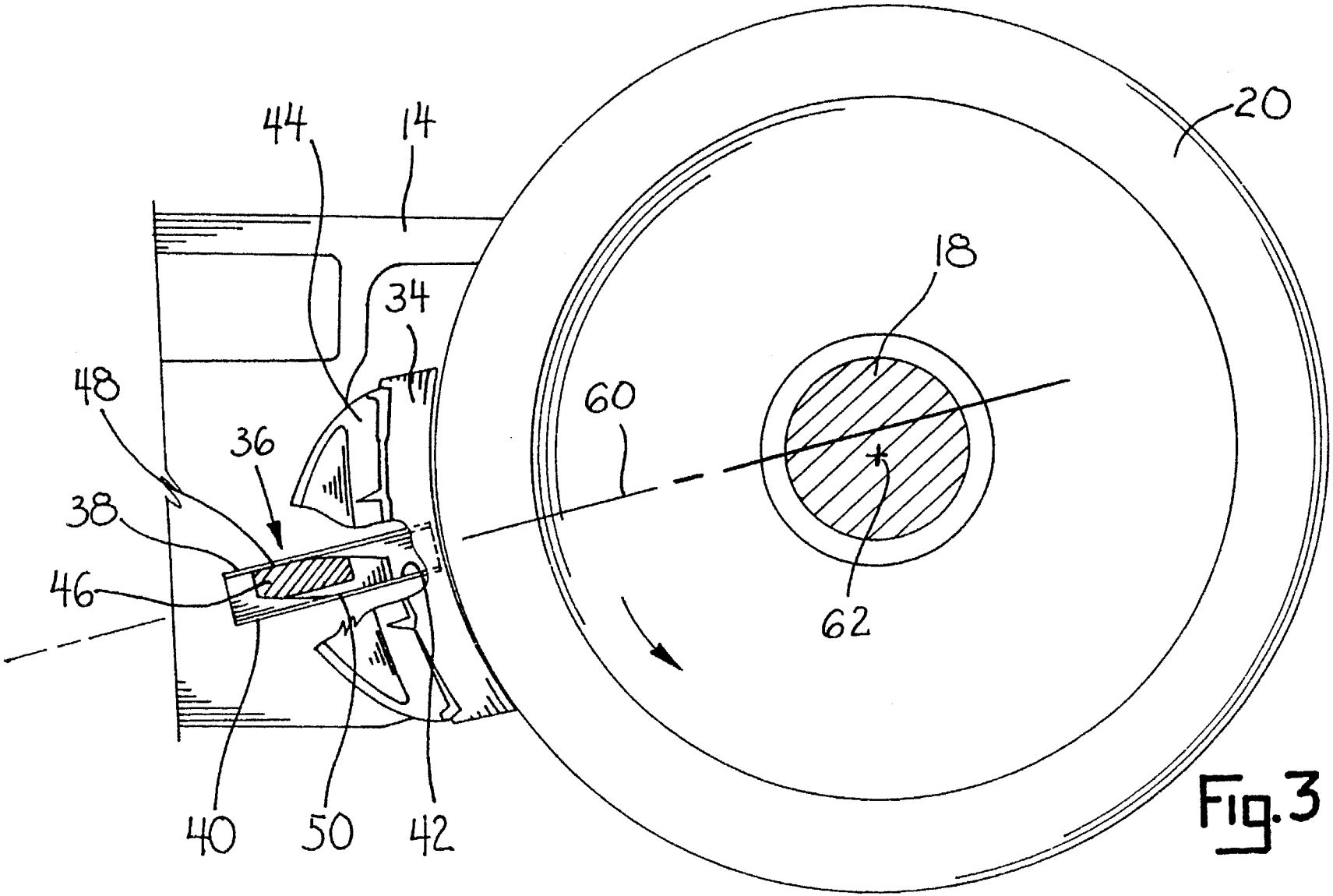
FIG. 3 is a sectional view similar to FIG. 2, but showing the beam approaching the braked position.
Figure 4:
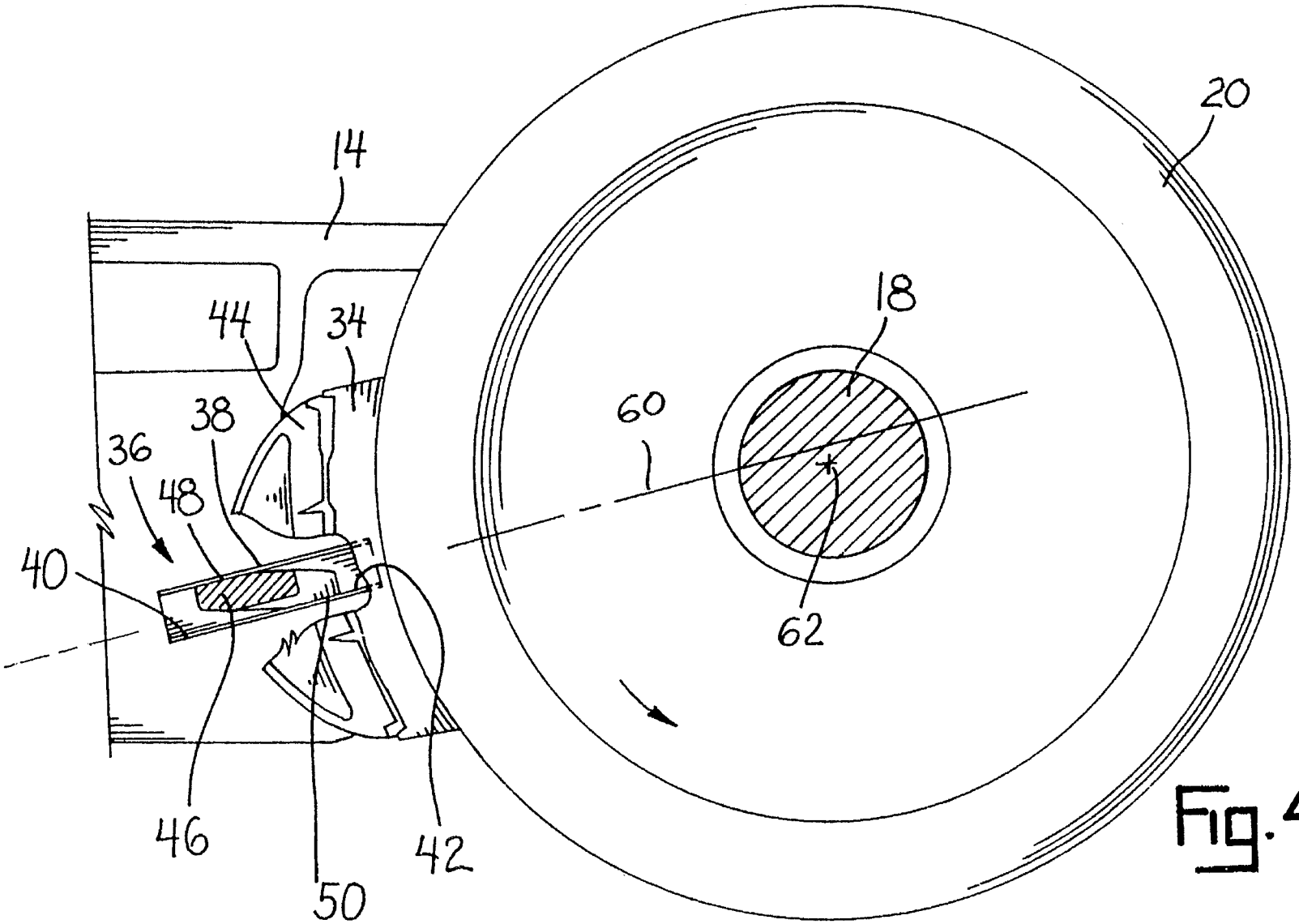
FIG. 4 is a sectional view similar to FIGS. 2 and 3 with the beam in a fully braked position.
Figure 2:
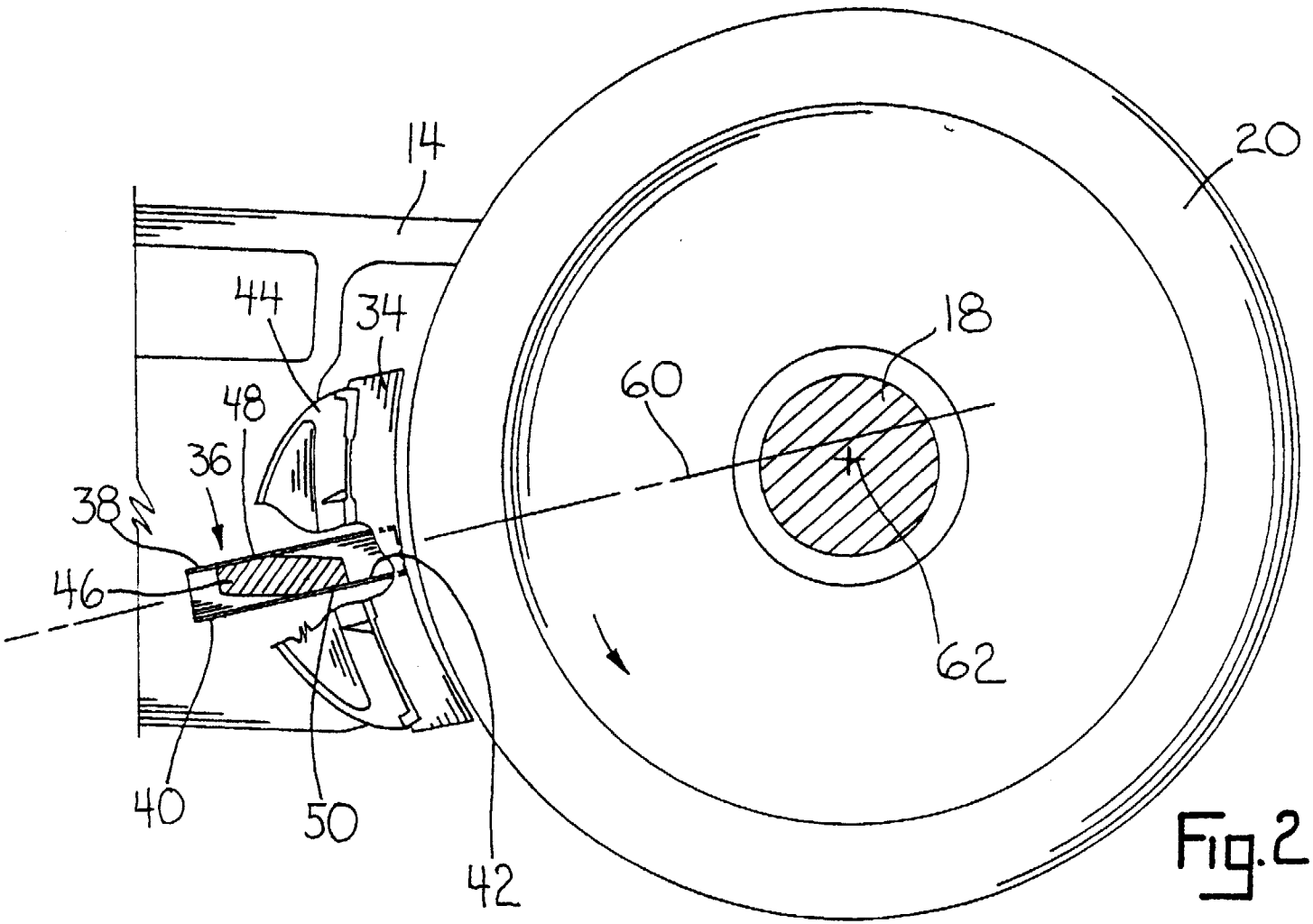
Figure 3:
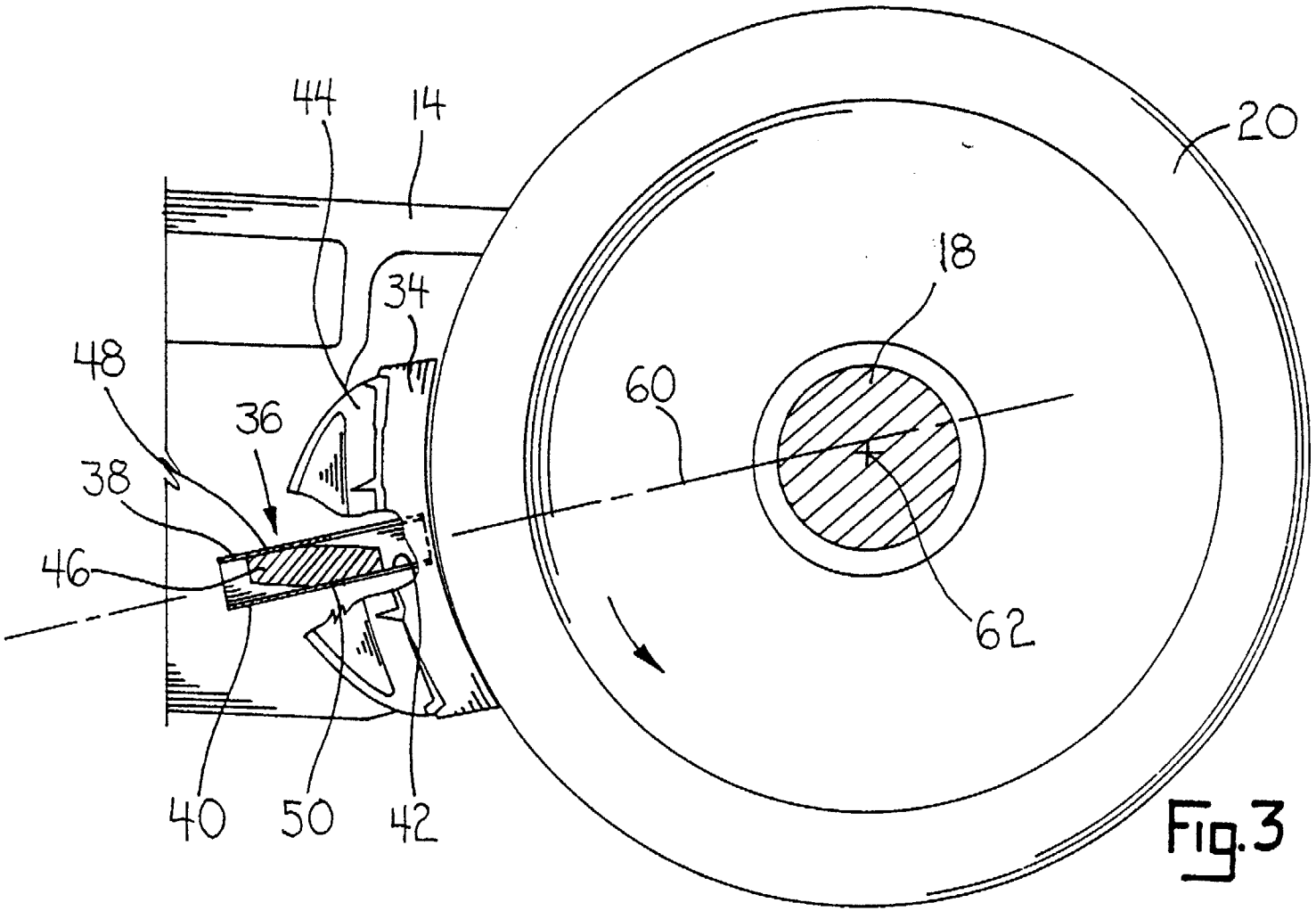
Figure 4:
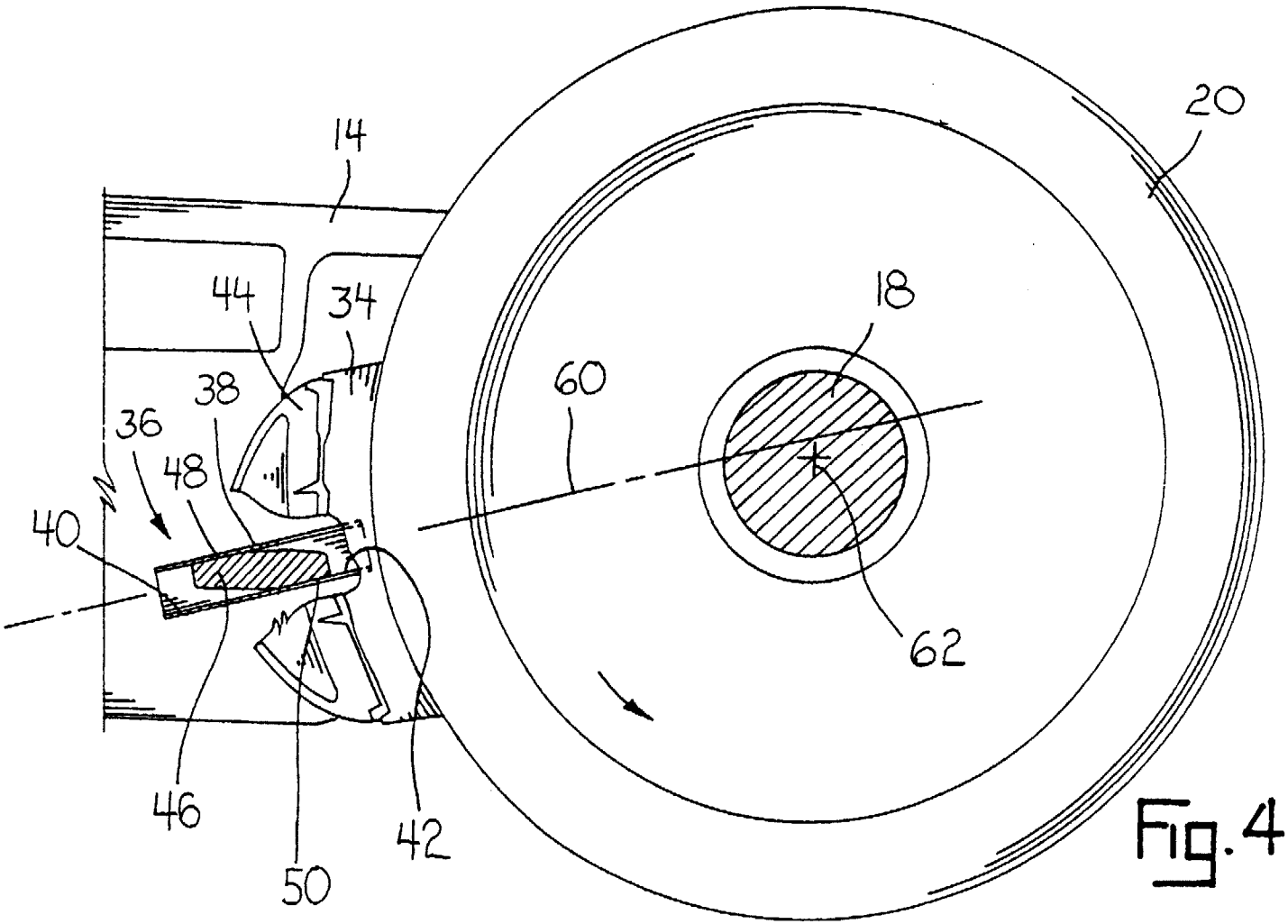

Frame rails 14 each include guide channel parts 36. As shown in FIGS. 2–4, each guide channel part 36 is defined by top wall 38 and spaced bottom wall 40 to define a slot or channel 42. Typically, channel parts 36 are oriented at an oblique angle relative to the upper and lower edges of frame rails 14 as shown. The orientation of guide channel parts will be discussed in detail subsequently.

Each opposed brake beam 32 carries brake shoes 34, preferably of a fiber composite material. Brake shoes 34 are secured to brake heads 44 of brake beams 32 as by mounting straps (not shown). Each brake beam 32 includes end extension parts 46 located at each end of each beam. Extension parts 46 are slidably fitted in each channel part 36 and reciprocate within channel 42.

Each extension part 46 is of a generally polygonal cross-section, for example a generally rectangular cross-sectional configuration with noted exceptions. As shown, two of the opposite diagonal corners define oblique angle surfaces 64,66. The other two opposite diagonal corners define spaced parallel surfaces 48,50 which are offset longitudinally from each other. Extension parts 46 are either fixedly secured to brake beams 32 or may be integrally formed as part of each beam.

FIGS. 2–4 illustrate the operation of brake system 22 paying particular attention to the roles played by extension parts 46. FIG. 2 illustrates brake system 22 in an unbraked position with brake shoes 34 spaced from railcar wheels 20. In this position brake beams 32 are fully retracted with the centerline 60 of each guide channel 42 slightly offset from the center axis 62 of each wheel 20.

FIG. 3 illustrates the position of one of brake beams 32 and its associated brake shoe 34 as they approach the braked position. Beams 32 extend under the influence of power cylinder 24, levers 28 and 30, and slack adjuster 26 in a commonly known manner. Due to the slight offset of each guide channel 42 from the center axis of rotation of each wheel 20, the lower edge of each brake shoe 34 contacts the wheel first as shown in FIG. 3. As each beam 32 continues to shift towards the full braked position of FIG. 4, more of the shoes 34 come into contact with wheels 20. When each shoe 34 is in flush contact with its respective wheel 20, flat surfaces 48, 50 of each extension 46 which are positioned next to walls 38,40 respectively are rotated into contact with the walls to prevent the rotation of each beam 32, which in turn minimizes and prevents uneven wear on brake shoes 34.

It is understood that the description and illustrations of the operation of a single beam 32 and brake shoe 34 apply equally to all beams 32 and shoes 34 used on each railcar 10. It is further understood that the invention is not limited to the above description but may be modified within the scope of the following claims.

I claim:

1. In a railcar including a frame, wheels connected to said frame, a braking system connected to said frame, said braking system including a brake beam, means for shifting said brake beam between a braked position and an unbraked position, brake shoes carried by said brake beam and located adjacent said wheels, said brake shoes frictionally engaging said wheels to stop said railcar when the brake beam is in its said braked position, the improvement wherein said brake beam comprises anti-torque means for preventing rotation of the brake beam when shifted into said braked position, said anti-torque means including an extension part connected to said brake beam, channel means defined by spaced parallel walls connected to said rail car frame for slidably accepting said extension part, said extension part fitted within said channel means and being of a generally rectangular cross-sectional configuration and including two spaced parallel longitudinally offset flattened portions at opposite diagonal corners thereof and two spaced oblique surfaces at the other opposite diagonal corners thereof, said opposite diagonal corners having generally right angles, one of said flattened portions being positioned next to one of said channel means walls and the other of said flattened portions being positioned next to the other of said channel means walls, wherein each of said flattened portions contacts one of said channel means wall when the brake beam is so shifted into its said braked position.

2. The railcar of claim 1 wherein said channel means defines a centerline of travel for said extension means, said wheels defining a central axis of rotation, said centerline of travel offset from said central axis of rotation whereby one end edge of each brake shoe contacts said wheel prior to an opposite end edge of the brake shoe contacting said wheel.

3. In a railcar including a frame, wheels connected to said frame, a braking system connected to said frame, said braking system including a brake beam, means for shifting said brake beam between a braked position and an unbraked position, brake shoes carried by said brake beam and located adjacent said wheels, said brake shoes frictionally engaging said wheels to stop said railcar when the brake beam is in its said braked position, the improvement wherein said brake beam comprises anti-torque means for preventing rotation of the brake beam when shifted into said braked position, said anti-torque means including an extension part connected to said brake beam, channel means defined by spaced parallel walls connected to said rail car frame for slidably accepting said extension part, said extension part fitted within said channel means for sliding in a longitudinal direction and being of a generally polygonal cross-sectional configuration and including two spaced parallel longitudinally offset flattened portions at opposite diagonal corners thereof and two spaced oblique surfaces at the other opposite diagonal corners thereof, each flattened portion extending from one of said opposed diagonal corners and terminating at one of said oblique surfaces, one of said flattened portions being positioned next to one of said channel means walls and the other of said flattened portions being positioned next to the other of said channel means walls, wherein each of said flattened portions contacts one of said channel means walls when the brake beam is so shifted into its said braked position.

* * * * *

UNITED STATES PATENT AND TRADEMARK OFFICE

CERTIFICATE OF CORRECTION

PATENT : 5,456,337

DATED : October 10, 1995

INVENTOR(S) : Robert G. Jackson

It is certified that error appears in the above-identified patent and that said Letters Patent is hereby corrected as shown below:

The title page, showing the illustrative Figure should be deleted and substitute therefor the attached title page.

In the drawings, Figs. 2-4, should be deleted to be substituted therefor with Figs. 2-4, as shown on the attached pages.

Signed and Sealed this

Thirteenth Day of October 1998

*Attest:*

*Attesting Officer*

Bruce Lehman

BRUCE LEHMAN

*Commissioner of Patents and Trademarks*

United States Patent [19]

Jackson

[11] Patent Number: 5,456,337

[45] Date of Patent: Oct. 10, 1995

[54] ANTI-ROTATION MEMBER FOR RAILCAR BRAKE BEAM

[76] Inventor: Robert G. Jackson, 1556 Jasmine Rd., St. Joseph, Mich. 49085

[21] Appl. No.: 373,872

[22] Filed: Jan. 17, 1995

Related U.S. Application Data

[63] Continuation of Ser. No. 114,833, Sep. 2, 1993, abandoned.

[51] Int. Cl.[6] ..... B66D 13/00; F16D 65/14

[52] U.S. Cl. ..... 188/52; 188/212; 188/222.6; 188/233.3

[58] Field of Search ..... 188/53, 54, 55, 188/197, 212, 207, 219.1, 219.6, 222.1, 222.6, 223.1, 231, 233.3

[56] References Cited

U.S. PATENT DOCUMENTS

| | | | |
|---|---|---|---|
| 2,170,123 | 8/1939 | Busch | 188/212 |
| 2,918,149 | 12/1959 | McClure et al. | 188/197 |
| 3,169,609 | 2/1965 | Opsahl | 188/222.6 |
| 4,480,721 | 11/1984 | Murphy | 188/233.3 |
| 4,519,480 | 5/1985 | Nelson | 188/222.6 |

*Primary Examiner*—John J. Oberleitner
*Assistant Examiner*—Kevin D. Rutherford
*Attorney, Agent, or Firm*—Baker & Daniels

[57] ABSTRACT

An anti-rotation extension for a railcar braking system. The extension is connected to a brake beam and rides in a frame located guide channel. The channel is preferably oriented offset from the center axis of rotation of the roller wheels. The extension preferably includes flattened portions to prevent rotation of the beam as the brakes are applied.

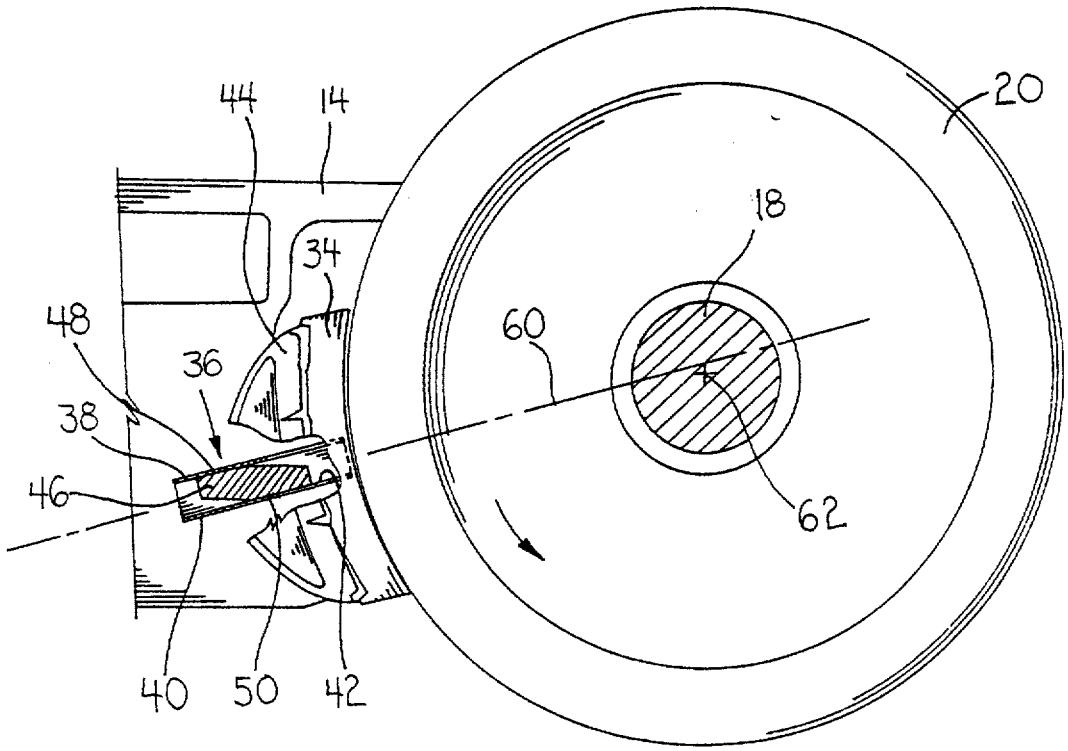

3 Claims, 4 Drawing Sheets